US005368495A

United States Patent [19]

Raby, Sr. et al.

[11] Patent Number: 5,368,495

[45] Date of Patent: Nov. 29, 1994

[54] METHOD AND ADAPTER FOR RELOCATING A FLUORESCENT TUBE IN A FIXTURE

[76] Inventors: Frederick R. Raby, Sr.; Bruce R. Raby, both of 3030 N. Middle Side Road, Amherstburg, Ontario, Canada, N9V 2Y9

[21] Appl. No.: 93,807

[22] Filed: Jul. 19, 1993

[51] Int. Cl.[5] ..... H01R 33/02

[52] U.S. Cl. ..... 439/226; 439/235; 362/217

[58] Field of Search ..... 439/226, 227, 228, 229, 439/232, 233, 234, 235, 239, 240; 362/217, 220, 221, 228, 260

[56] References Cited

U.S. PATENT DOCUMENTS 1,951,502 3/1934 Cadieux ..... 439/226
1,993,943 3/1935 Nunez ..... 439/226
2,024,409 12/1935 Wilde ..... 439/226
4,799,134 1/1989 Pinch et al. ..... 439/226
4,928,209 5/1990 Rodin ..... 439/226

*Primary Examiner*—Larry I. Schwartz
*Assistant Examiner*—Hien D. Vu
*Attorney, Agent, or Firm*—John R. Benefiel

[57] ABSTRACT

A method and adapter allows relocation of fluorescent light tubes to be offset from existing light fixture sockets, an adapter installed in each of a pair of opposite fixture sockets and having a plug connected at the ends of a pair of electrical leads able to receive the relocated fluorescent tube pins and establish a power connection to the tube in the offset location. Each adapter also has a transverse extension rod and tube holding clip element mounted thereto to provide a support for a respective end of the relocated tube.

10 Claims, 2 Drawing Sheets

METHOD AND ADAPTER FOR RELOCATING A FLUORESCENT TUBE IN A FIXTURE

BACKGROUND OF THE INVENTION

This invention concerns fluorescent light fixtures and more particularly accessories for reducing the power consumption of such fixtures.

In recent years there has been a trend to reducing the number of fluorescent tubes installed in fixtures in offices and commercial establishments, often with lower wattage tubes. This is for the purpose of substantially reducing the power consumption for lighting. Often, a reflector is added so that the light output of the fixture is not correspondingly reduced.

See U.S. Pat. No. 4,514,793 issued on Apr. 30, 1985, for a "Reflector System for Securing to a Light Source", describing an arrangement for retrofitting an existing light fixture with a reflector to enhance the light output.

One approach which has become a common practice is to replace the four standard 40 watt tubes in a four tube fixture with two lower wattage tubes. However, a drawback to this approach is that if two tubes are simply removed and the remaining two installed in one or the other of the sockets, there will appear dark shadows due to the absence of the other two light tubes.

The appearance of such shadows is often felt to be objectionable, and to avoid this result, it has been the usual practice to relocate two of the sockets closer to the center of the fixture by cutting new recesses into the sheet metal and removing and reinstalling the socket sets. Such an approach is relatively costly since requiring a time consuming effort on the part of an electrician. Also, often the relocated tube is skewed due to a failure to properly locate each socket.

Accordingly, it is an object of the present invention to provide an adapter and method for relocating a fluorescent tube in a light fixture quickly and easily, such as to minimize the labor and thus the cost of such relocation.

SUMMARY OF THE INVENTION

According to the concept of the present invention, the fluorescent tubes are relocated by use of an adapter which is comprised of an adapter body having two conductive pins projecting from one end thereof configured and positioned to be able to be installed in an existing socket. The conductive pins are connected to a pair of insulated electrical leads extending from the adapter body and having a plug attached at the end thereof able to be plugged into the end of a fluorescent tube to provide power. The length of the leads is sufficient so that the plug can reach the tube end in its related position.

The adapter also includes an extension rod projecting from the side thereof with a tube gripping spring clip attached to the free end of the extension rod. The spring clip allows a fluorescent tube to be installed and held therein and an offset location with respect to the socket, with the plug providing an electrical power connection to the tube which may thereby be relocated in the fixture to be in a more closely centered position to eliminate the shadows when two tubes are employed in a four tube fixture.

An adapter is provided at each socket such as to support each end of a respective relocated light tube.

The extension rod and spring clip tube holder may be threadedly mounted in the adapter housing to allow for adjustment of the position of the tube by varying the projecting length of the extension rod. The spring clip may be joined to the extension rod by a rotary connection to allow adjustment with an end of a fluorescent tube held therein.

The adapter conductive pins are preferably formed with circumferential grooves, as by being threaded such as to engage the socket contacts and be retained against endwise movement of the adapter out of the socket. Alternatively, a clip may be employed hooking onto the adapter and around the back of the socket.

As a further alternative, the tube support may be fastened to the fixture housing with the adapter providing only a electrical connection between the socket and a respective end of the relocated light tube.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
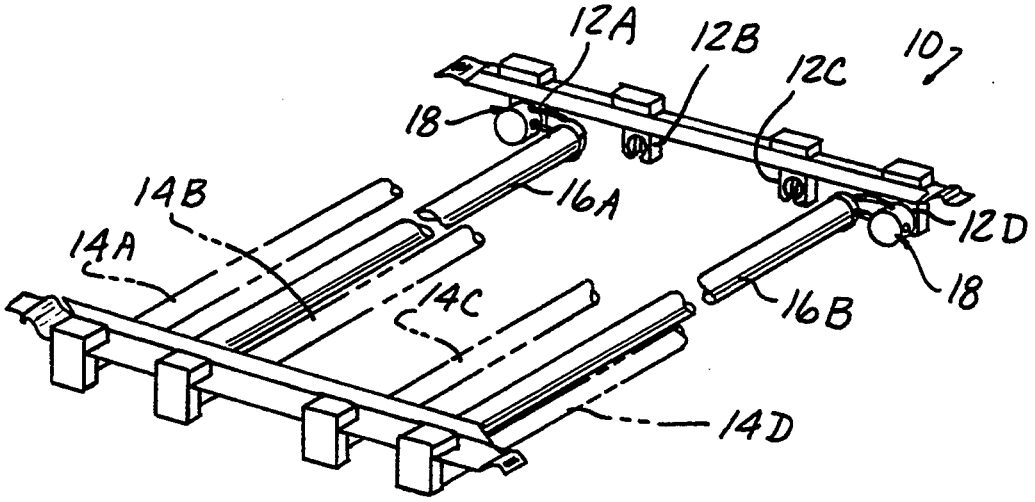
FIG. 1 is a perspective view of a four tube fluorescent light fixture converted to a two tube fixture with the use of adapters according to the present invention.

Referring to the drawings and particularly FIG. 1, a four tube light fixture 10 is shown comprised of generally rectangular housing having four sockets 12A–12D (shown in phantom).

According to the present practice, four tubes 14A–14D originally installed have been replaced by two fluorescent tubes preferably of smaller size and lower wattage 16A, 16B, which are positioned at a location intermediate the sockets 12A, 12B, 12C, and 12D by means of the adapters 18A, 18B according to the present invention.

Figure 3:
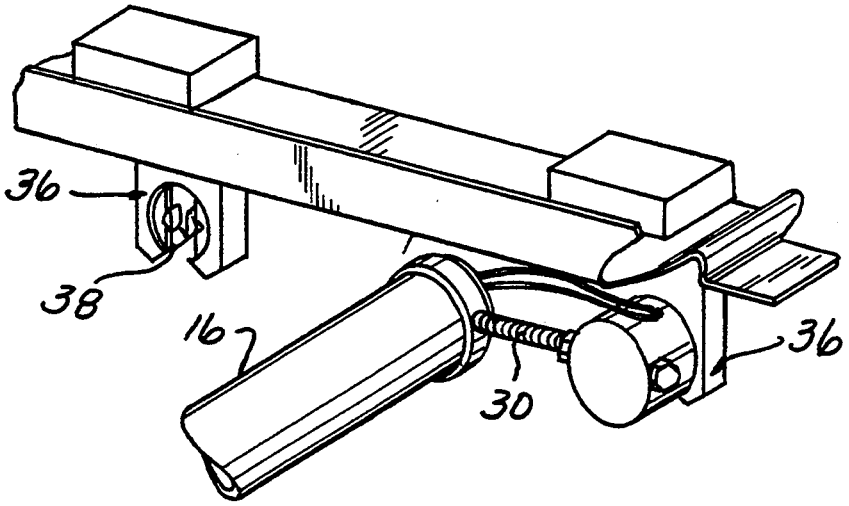
FIG. 3 is a fragmentary view of a portion of the light fixture showing the installation of the adapter device according to the present invention.
Figure 2:
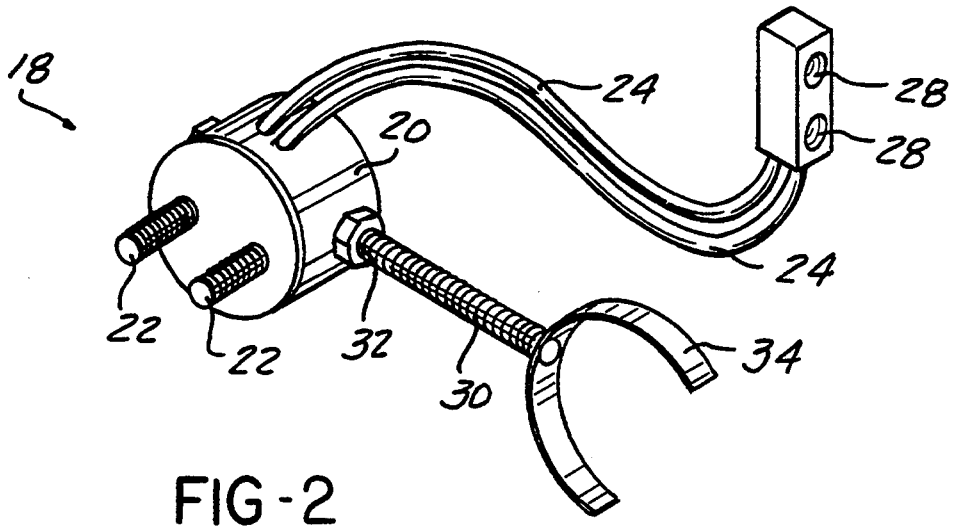
FIG. 2 is an enlarged perspective view of an adapter according to the present invention.
Figure 5:
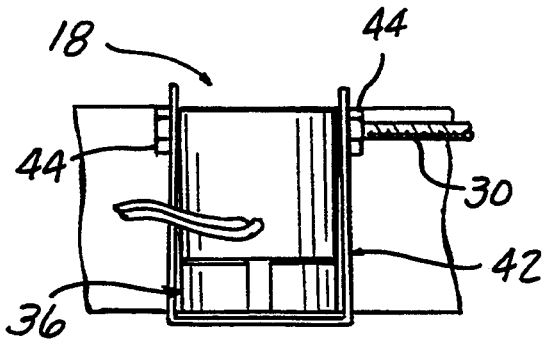
FIG. 5 is a plan view of an adapter according to the present invention installed in a light socket with a retention clip installed on both the adapter and socket.
Figure 5A:
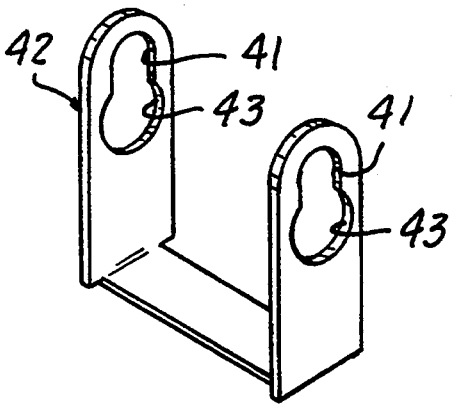
FIG. 5A is a perspective view of the retention clip shown installed in FIG. 5.

Referring to FIGS. 2 and 3 the further details of the adapter 18 can be seen. One adapter 18 is provided for each end of each of the replacement tubes 16A 16B such that a total of four adapters 18 is required for the conversion of a four tube light fixture to a two tube light fixture.

Adapter 18 includes an adapter body 20 which may be of molded plastic in a generally cylindrical shape having a pair of conductive pins 22 projecting from one end face thereof. The spacing of the pins 22 corresponding to the standard spacing of the socket engaging pins of a standard fluorescent tube. The conductive pins 22 are preferably threaded for a purpose as will be described hereinafter.

Each of the conductive pins 22 is connected to a respective insulated electrical lead 24 of a predetermined length extending from the adapter body 20. Each lead 24 terminates in a plug 26 having spaced pin sockets 28 configured to mate with the contact pins of a standard fluorescent light tube.

Extending from the adapter body 20 in a transverse direction from the direction in which the conductive pins 22 is an elongated extension rod 30 which may be threadedly received in a corresponding bore 32 of the adapter body 20.

At the free end of the extension rod 30 is a C-shaped tube gripping spring clip 34 which is configured to be able to resiliently grip an end of a fluorescent tube.

According to the method of the present invention, the adapter 18 is installed on one of the sockets 36 of the light fixture 10 as shown in FIG. 3 with the conductive pins 22 inserted through the socket slot 38. The adapter 18 is rotated into position to establish a electrical connection of the pins 22 with the contacts of the socket 36. When rotated to the seated position, the extension rod 30 extends towards the next adjacent socket 36, positioning the spring C-clip 34 in approximately the mid position between the adjacent sockets 36.

The plug 26 may then be installed on the one end of the fluorescent tube 16 and the one end of the tube snap fitted into the spring clip 34 to be mounted in a relocated position offset from the socket 36 in which the adapter 18 is installed.

Figure 4:
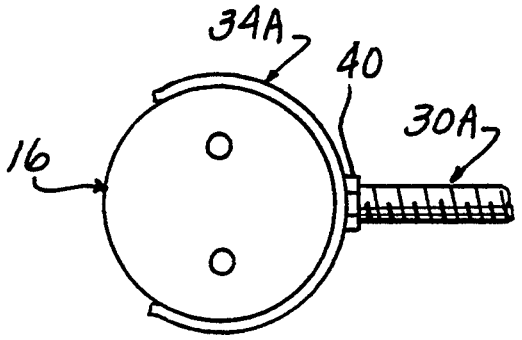
FIG. 4 is a fragmentary view of the tube holding spring clip and extension rod showing a variation in the construction thereof.

The extension rod 30 may be of a fixed length designed to a particular fixture configuration, or alternatively as shown in FIG. 4, a rotary connection 40 may be provided between the spring clip 34A and the extension rod 30A allowing rotation of the rod 30A after the tube 16 is installed. This allows adjustment of the position of the tube 16 after installation.

The same procedure is carried out on the opposite end of the tube 16 with a corresponding adapter 18 installed in the opposite socket.

The threading of the contact pins 22 forms circumferential grooving which will engage the socket contacts and restrain endwise movement of the adapter body 20 out of the socket 36 in which it is installed.

Alternatively, a U-shaped clip 42 may be utilized, having large diameter openings 43 assembled over bosses 44 and slots 41 engaging corresponding grooves in the oppositely located boss portions 44 when the clip 42 is extended out and locked around the back of the socket 36 such as to prevent the adapter 18 from moving away from the socket 36 on which it is installed.

Figure 6:
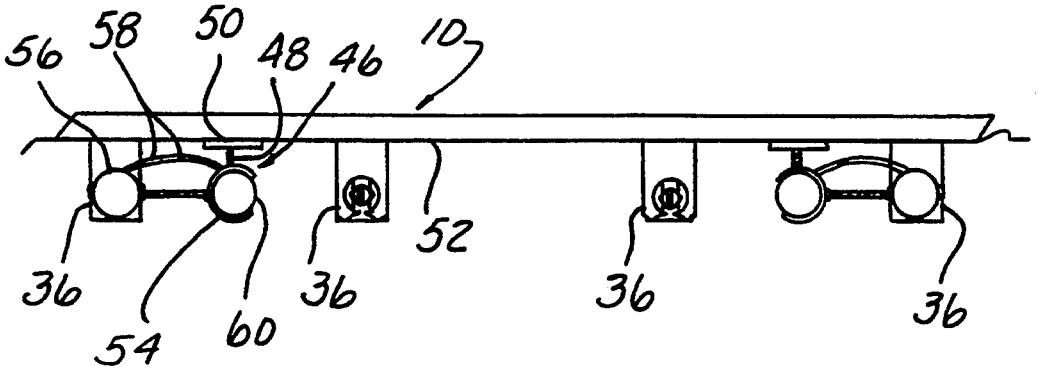
FIG. 6 is a transverse diagrammatic view of a four tube light fixture showing an alternative installation of the tube holding spring clip.

Alternatively, a separate tube gripping clip 46 may be installed separately from the adapter 18, as shown in FIG. 6, in which a rod 48 is fixed to a base plate 50, in turn affixed as by screws to the inner surface 52 of the fixture 10, positioning a tube holder clip 54 at the appropriate intermediate location between sockets 36.

The adapter 56 in this case provides only an electrical connection via leads 58 to the end of the replacement fluorescent tube 60 installed in the spring clip tube holder 54.

Accordingly, it can be appreciated that by use of the disclosed adapter and method, the replacement tubes can be quickly and easily installed in an intermediate relocated position closer to the center of the fixture 10 to eliminate the shadowing problem without incurring extensive skilled labor to therefore allow a low cost conversion. An accurately controlled relocation position also results.

We claim:

1. An adapter for offsetting a light tube in a fluorescent light fixture having fixture sockets at either end thereof having socket contacts therein configured and spaced to receive a pair of pin contacts at each end of said fluorescent tubes, said adapter comprising:

an adapter body having a pair of conductive pins projecting herefrom configured and spaced to be received into a fixture socket and make an electrical connection with said socket contacts;

a pair of insulated electrical leads each electrically connected to a respective conductive pin, said leads extending from said adapter body;

a plug having a pair of female socket contacts configured and spaced to receive a pair of pin contacts of a fluorescent tube, each of said contacts connected to a respective lead, whereby a fluorescent tube can be relocated in said fixture while being electrically powered by a connection with an existing socket by being connected thereto with said adapter and, an extension rod having one end mounted to said adapter body, said extension rod extending transversely to said conductive pins and having a tube holding clip mounted at another end thereof, said clip adapted to grasp a fluorescent tube, whereby said extension rod is able to provide support for one end of a fluorescent tube.

2. The adapter according to the claim 1 wherein said conductive pins are each formed with circumferential grooves engagable with said socket contacts to prevent endwise movement out of said fixture socket.

3. The adapter according to claim 1 wherein said extension rod is mounted to said adapter body to be adjustable lengthwise whereby the position of a fluorescent tube can be adjusted thereby.

4. The adapter according to claim 3 wherein said extension rod is threaded to said adapter body to provide said lengthwise adjustable mounting.

5. The adapter according to claim 4 further including a rotary connection between said clip and said another end to allow rotation of said extension rod with a fluorescent tube held in said clip.

6. The adapter according to claim 1 further including a clip hooked onto said adapter body and extending around a fixture socket having said adapter installed therein to prevent endwise movement of said adapter out of said fixture socket.

7. A method of relocating a fluorescent light tube in a fixture having a pair of fixture sockets each at one end of said fixture receiving either end of said fluorescent light tube to create an electrical power connection and support therefor, comprising the steps of:

removing said fluorescent light tube from said fixture sockets;

installing a pair of adapters, each in a respective fixture socket so that each of said adapters creates an electrical power connection between a respective fixture socket contact and contacts of a plug by connecting therebetween a pair of insulated electrical leads of a predetermined length extending from each of said adapters;

mounting said fluorescent light tube at said relocated position in said fixture able to be reached by said electrical leads by mounting an extension rod to each adapter and holding an end of said fluorescent light tube to an end of said extension rod.

8. The method according to claim 7 further including the step of adjusting said extension rod with respect to said adapter to position said fluorescent tube held thereby at said relocated position.

9. An adapter for offsetting a light tube in a fluorescent light fixture having fixture sockets at either end thereof each having socket contacts therein configured and spaced to receive a pair of pin contacts at each end of said fluorescent tube, said adapter comprising:

an adapter body having a pair of conductive pins projecting therefrom configured and spaced to be received into a fixture socket and make an electrical connection with said fixture socket contacts;

a pair of insulated electrical leads each electrically connected to a respective conductive pin, said leads extending from said adapter body;

a plug having a pair of contacts configured and spaced to receive a pair of pin contacts of a fluorescent tube, each of said contacts connected to a respective lead, said plug not being supported by said adapter; and means for securing said pair of conductive pins to said fixture socket contacts so as to prevent endwise movement out of said fixture socket contacts;

whereby a fluorescent tube can be relocated in said fixture while being electrically powered by a connection with an existing socket by being connected thereto with said adapter;

wherein said means securing said pair of conductive means pins in said fixture contacts comprises a series of circumferential grooves engageable with said fixture socket contacts to prevent endwise movement out of said fixture socket contacts.

10. An arrangement for offsetting a light tube in a fluorescent light fixture having fixture sockets at either end thereof having socket contacts therein configured and spaced to receive a pair of pin contacts at each end of said fluorescent tube, said arrangement including:

a pair of adapters, each adapter comprised of an adapter body having a pair of conductive pins projecting from an end of said adapter body configured and spaced to be received into a fixture socket and make an electrical connection with said fixture socket contacts, each of said adapter bodies also carrying connecting means;

a pair of clips having openings thereof for engaging with said connecting means of said adapter, each clip extending around a respective fixture socket and engaging a respective one of said adapter bodies with said conductive pins thereof received into said respective mating fixture socket, each clip engaging said connecting means to hold said respective adapter against said fixture socket;

pairs of insulated electrical leads electrically connected to a respective conductive pin, each pair of leads extending from a respective adapter body;

a plug connected to each respective pair of electrical leads, each plug having a pair of female socket contacts configured and spaced to receive a pair of pin contacts of a fluorescent tube, each of said contacts connected to a respective lead, said plugs not being supported by the associated adapter body, whereby a fluorescent tube can be relocated in said fixture while being electrically powered by a connection with an existing socket at each end thereof by being connected thereto with said adapter, each of said adapters at each end secured to a respective fixture socket with said clip.

* * * * *